US008684663B2

(12) United States Patent
Bekyigit et al.

(10) Patent No.: US 8,684,663 B2
(45) Date of Patent: Apr. 1, 2014

(54) STEAM TURBINE WITH RELIEF GROOVE ON THE ROTOR

(75) Inventors: Rabiye Bekyigit, Wald-Michelbach (DE); Philipp Brunner, Baden (CH); Jian Chen, Brugg (CH); Rolf Dobler, Schriesheim (DE); Jozo Drmic, Nussabaumen (CH); Andreas Ehrsam, Baden (CH); Maurus Herzog, Schinznach-Dorf (CH); Davor Kriz, Baden (CH); Thomas Mokulys, Wurenlingen (CH); Martin Reigl, Ehrendingen (CH); Luca Ripamonti, Rieden (CH); Thomas Schreier, Neuenhof (CH); Giorgio Zanazzi, Baden (CH)

(73) Assignee: Alstom Technology Ltd., Baden (CH)

( * ) Notice: Subject to any disclaimer, the term of this patent is extended or adjusted under 35 U.S.C. 154(b) by 817 days.

(21) Appl. No.: 12/893,761

(22) Filed: Sep. 29, 2010

(65) Prior Publication Data

US 2011/0103970 A1 May 5, 2011

(30) Foreign Application Priority Data

Sep. 30, 2009 (CH) ..... 1521/09

(51) Int. Cl.
*F01D 25/12* (2006.01)

(52) U.S. Cl.
USPC ..... 415/115; 415/199.5; 415/216.1; 415/230; 415/174.5

(58) Field of Classification Search
USPC ..... 415/115, 104, 199.5, 216.1, 230
See application file for complete search history.

(56) References Cited

U.S. PATENT DOCUMENTS

| | | | | |
|---|---|---|---|---|
| 2,304,994 | A * | 12/1942 | Franck | 415/107 |
| 2,823,891 | A * | 2/1958 | Baker et al. | 415/93 |
| 2,920,867 | A * | 1/1960 | Reese et al. | 415/96 |
| 3,588,265 | A * | 6/1971 | Berry | 415/17 |
| 4,615,657 | A | 10/1986 | Kreitmeier | |
| 4,699,566 | A | 10/1987 | Miller | |
| 6,082,962 | A | 7/2000 | Drosdziok et al. | |
| 6,213,710 | B1 | 4/2001 | Remberg | |
| 6,824,351 | B2 | 11/2004 | Endries et al. | |
| 7,264,438 | B2 | 9/2007 | Diesler et al. | |
| 2005/0163612 | A1 | 7/2005 | Reigl | |
| 2009/0074561 | A1 | 3/2009 | Schirle et al. | |

FOREIGN PATENT DOCUMENTS

| | | |
|---|---|---|
| DE | 16 52 684 | 3/1953 |
| DE | 14 01 432 | 3/1969 |
| DE | 2423036 A1 | 12/1974 |
| DE | 34 24 138 | 1/1986 |

(Continued)

*Primary Examiner* — Ninh H Nguyen
(74) *Attorney, Agent, or Firm* — Buchanan Ingersoll & Rooney PC

(57) ABSTRACT

A steam turbine is provided having a relief groove which is arranged in the region of the equalizing piston and extends in the circumferential direction of the rotor. The relief groove, with regard to an inlet passage, is arranged in the axial upstream direction so that it is arranged on the rotor outside a region in which the steam flow enters the bladed flow path via the inlet passage. The relief groove, with regard to the first blade row, is arranged in a region in which the greatest thermal stresses can arise in the rotor. As an option, the relief groove has a cover for reducing vortex flows, and also devices for reducing heating of the groove or devices for active cooling. The steam turbine allows an increased number of risk-free running up and running down operations of the steam turbine with minimum detriment to the turbine performance.

17 Claims, 9 Drawing Sheets

(56) References Cited

FOREIGN PATENT DOCUMENTS

| | | | |
|---|---|---|---|
| DE | 19620828 | C1 | 9/1997 |
| DE | 10 2007 043 764 | | 10/2008 |
| EP | 1154123 | A1 | 11/2001 |
| EP | 1455066 | A1 | 9/2004 |
| EP | 1724437 | A1 | 11/2006 |
| EP | 1788191 | A1 | 5/2007 |
| FR | 2040011 | A | 1/1971 |
| GB | 1458524 | | 12/1976 |
| JP | 09125909 | A | 5/1997 |
| WO | 9738209 | A1 | 10/1997 |
| WO | 0186122 | | 11/2001 |
| WO | 2009135802 | A1 | 11/2009 |

* cited by examiner

STEAM TURBINE WITH RELIEF GROOVE ON THE ROTOR

FIELD OF INVENTION

The invention refers to a steam turbine with a relief groove on the rotor for relieving thermal stresses.

BACKGROUND

In rotors of steam turbines, local thermal stresses arise during running up and running down of the turbines, which are caused by the rapid change of the hot gas flows. Such stresses arise particularly in the region of the steam inlet of the high-pressure and intermediate-pressure steam turbines and often lead to crack developments in the region of the blade grooves, especially of the first blade rows. These can limit the operational service life of the rotor and particularly the number of risk-free running up operations of the turbine.

DE 2423036 discloses a turbine rotor disk with grooves which extend radially inwards between adjacent blades. The grooves serve for avoiding circumferential stresses on the edges of the rotor disks, which can arise on account of the thermal expansion of the rotor. On the base of each groove, a drilled hole is located in each case, into which a rivet is inserted.

EP 1724437 discloses a steam turbine with a fastening region for the rotor blades on the turbine rotor, the radial distance of which fastening region from the rotor axis reduces in the direction of the axial rotor blade thrust. Between the fastening region of the rotor blades and the equalizing piston, the rotor has a continuous recess (28) over the rotor periphery, which ensures an entry of steam from the inflow chamber in the inner casing to the equalizing piston and at the same time acts as a relief notch for the initial rotor blade thrust.

SUMMARY

An object of the invention is to create a steam turbine, especially a high-pressure or intermediate-pressure steam turbine, the turbine rotor of which has a device for relieving thermal stresses.

A steam turbine for operating with high-pressure or intermediate-pressure steam has a rotor, stator and an inlet passage for live steam which, downstream of the inlet passage, in a downstream direction of the operating steam flow, flows through the bladed flow path of the turbine. The turbine furthermore has a piston seal between rotor and stator and an equalizing piston. According to the invention, the steam turbine has a relief groove on its rotor for the purpose of relieving thermal stresses. The relief groove is arranged in the region of the equalizing piston of the rotor and extends in the circumferential direction of the rotor. The relief groove is therefore located at a point which is at a distance from the live steam inlet passage and, moreover, with regard to the inlet passage, in an axial direction which is opposite to the direction of the operating steam flow through the bladed flow path.

The relief groove, with regard to the first blade row in the bladed flow path, is arranged in a region in which the greatest thermal stresses would typically arise in the turbine rotor, especially during running up and running down of the turbine or during load changes. Moreover, the relief groove is arranged on the turbine rotor outside a region in which the steam flow enters the bladed flow path of the turbine via the inlet passage. This arrangement of the groove effectively reduces the thermal stresses, wherein at the same time the steam inlet flow is not impaired and therefore the performance of the machine is maintained.

A steam turbine with a relief groove on the rotor according to the invention brings about an extended operational service life in comparison to steam turbines of the prior art. The relief groove specifically allows an increased number of risk-free running up and running down operations of the steam turbine without detriment to the turbine performance. Moreover, the positioning of the relief groove according to the invention enables cooling of the groove with little cooling mass flow. Finally, the steam turbine according to the invention also allows easier inspection of the rotor by an inspection for crack development in the relief groove alone also giving reliable information about the state of the groove of the first blade row. In particular, the heat transfer in the region of the groove is reduced and therefore brings about a lower thermal load.

The relief groove preferably extends in the same shape over the entire periphery of the rotor. Its cross-sectional shape in this case can be of either symmetrical or asymmetrical design. In the asymmetrical design, the groove extends with increasing radial depth towards the live steam inlet passage.

In one embodiment, the relief groove is arranged in the region of the piston seal.

In a further embodiment of the invention, the relief groove has a cover in its opening. This has the effect of vortex flows inside the groove, which can arise from leakage flows in the piston seal, being reduced or even completely avoided. The arrangement of the relief groove in the region of the piston seal, together with the cover of the groove opening, in a further embodiment of the invention allows the arrangement of additional sealing strips on the cover which in the case of a relief groove without a cover would not be possible. As a result of this measure, an optimized sealing effect is made possible, despite the relief groove.

A cover of the relief groove can be realized either as an integral part of the stator or can be produced as a separate part and fastened on the stator, for example by hooks.

In a further embodiment of the invention, the relief groove additionally has a device for reducing the heat transfer and for controlling rotor vibrations. Since the relief groove is located in the vicinity of the hot live steam inflow, this can lead to the rotor heating up on the inside to an undesirable level as a result of high heat transfer. Furthermore, excitations of rotor vibrations can take place in the region of the relief groove. In order to avoid or at least to reduce these problems, the cover of the relief groove has a passage which extends axially at the level of the rotor surface. This ensures that a hot leakage flow from the piston seal can flow through this passage instead of finding its way into the relief groove.

In a further embodiment of the invention, the steam turbine has a cooling flow passage in the stator which, in the direction of the leakage flow, upstream of the relief groove, leads into the region of the piston seal. The relief groove has a cover with a passage level with the rotor surface.

In a further embodiment of the invention, the steam turbine has a cooling flow passage through the stator, which leads to a relief groove without a cover. The part of the stator which forms the wall of the live steam inlet passage extends radially inwards into the region of the bend of the inlet passage, where the passage leads into the bladed flow path of the turbine. A gap between stator and rotor extends from the inlet passage, partially radially, partially axially, as far as the relief groove. Cooling steam, which finds its way into the groove via the cooling flow passage, flows from the relief groove through the passage between stator and rotor into the live steam inlet passage. These cooling measures enable a reduction or even avoidance of excessive heating of the rotor.

In a further embodiment of the invention, the rotor is, in particular, a welded rotor.

Like designations in the different figures represent the same components in each case.

DETAILED DESCRIPTION OF THE PREFERRED EMBODIMENTS

Figure 1:
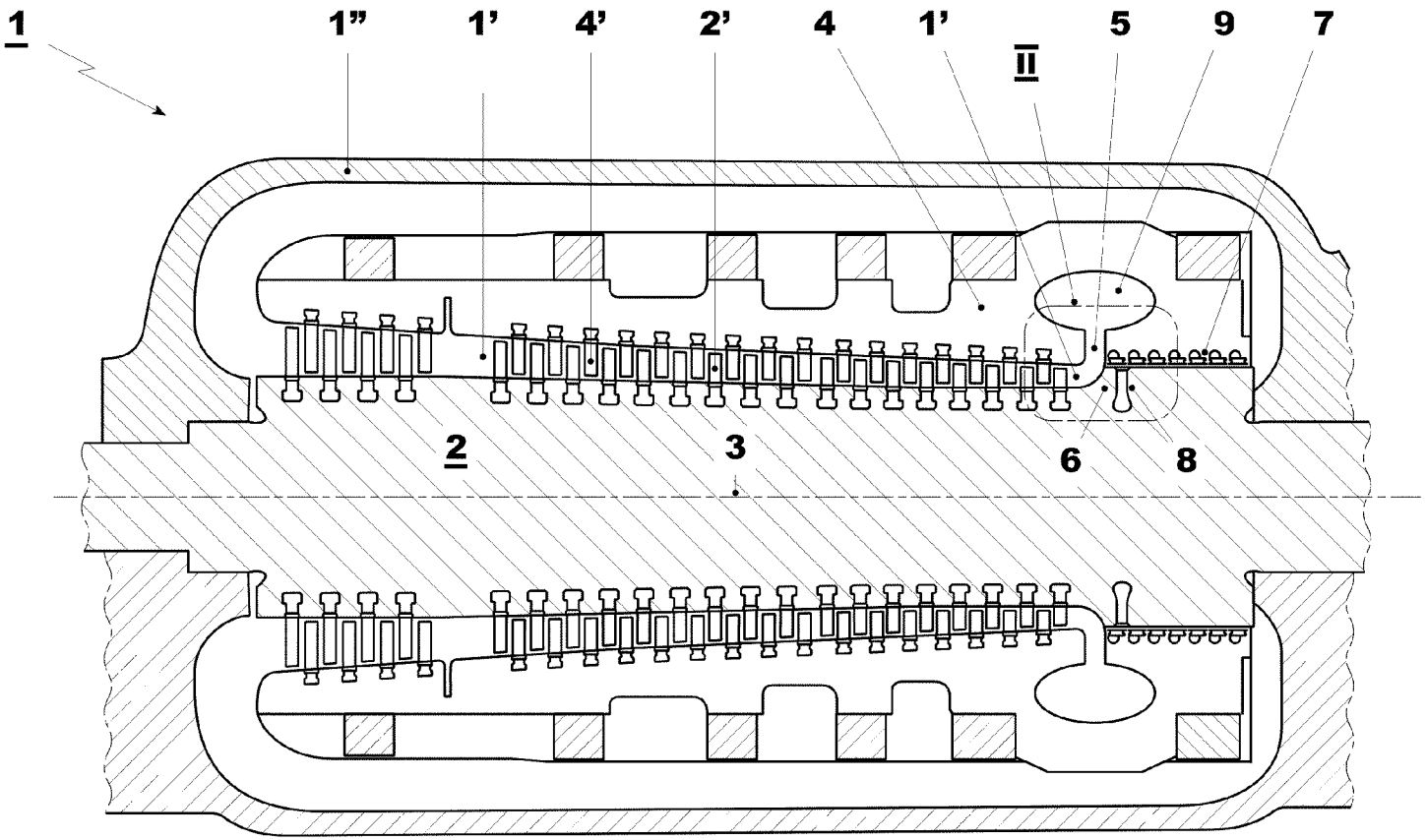
FIG. 1 shows a steam turbine in a cross-sectional view along the rotor axis with a relief groove according to the invention in an arrangement in the region of the equalizing piston and the piston seal.

FIG. 1 shows in a meridional cross section a steam turbine 1, for example a high-pressure steam turbine, the rotor 2 of which, with rotor axis 3 and stator or inner casing 4, form a bladed flow path 1', wherein rotor blades and stator blades 3', 4' are fastened on the rotor or on the stator. The steam turbine 1 is enclosed by an outer casing 1". An inlet passage 5 for the operating steam leads from an inlet scroll 9 into the axially extending bladed flow path 1', wherein the inlet passage 5 is defined by the stator 4 and a equalizing piston 6. The operating steam flows in the axial downstream direction from the end of the inlet passage through the bladed flow path, where it is expanded. In the axial upstream direction from the inlet passage 5, i.e. in the direction opposite from the downstream direction, a piston seal 7 extends between stator 4 and rotor 2. Also, an encompassing relief groove 8 is arranged in the rotor 2, at a distance from the inlet passage in the axial upstream direction and in the piston seal 7.

Figure 2:
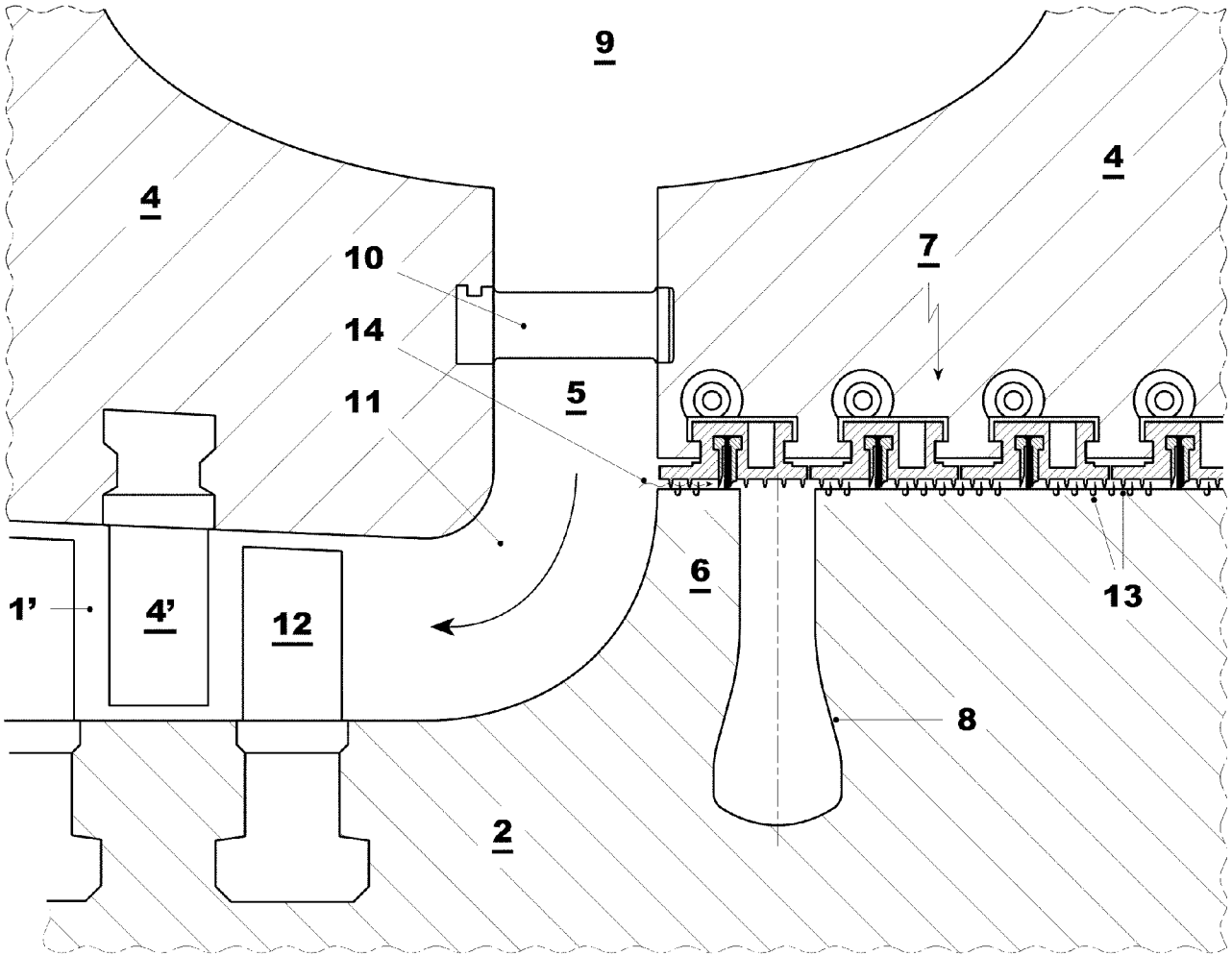
FIG. 2 shows a more detailed view according to the detail II in FIG. 1 of the relief groove according to the invention.

FIG. 2 shows in detail the inlet scroll 9 from which flows a live steam flow 11, via a guide vane row 10, through the inlet passage 5 and from there impinges upon the first rotor blade row 12. A leakage flow 14 finds its way from the live steam flow 11 through the piston seal 7 with sealing strips 13. The relief groove 8 is arranged axially at a distance from the inlet passage 5 and in the region of the equalizing piston 6. In this region, the relief groove can be arranged as close as possible to the first rotor blade row 12 which is affected most of all by thermal stresses and at the same time at a distance from the hot inlet steam flow 11. As a result, the inlet flow and operating flow can flow as far as possible without hinderance through the relief groove and without loss into the bladed flow path 1'.

The groove 8 extends over the entire periphery of the rotor 2 and extends from its opening on the rotor surface essentially radially inwards. The groove extends, for example, radially into the region of the depth of the blade grooves of the rotor blades 12. On its radially inner end, the relief groove is widened in comparison to its opening on the rotor surface. The widening on the radially inner end serves essentially for a notch effect being reduced as far as possible. The relatively narrow opening on the rotor surface is aimed at preventing hot steam, as far as possible, from being able to find its way from the leakage flow 14 into the groove 8 and therefore preventing vortex flows, as far as possible, from being able to arise there, which otherwise would lead to a local heating of the rotor.

Figure 2A:
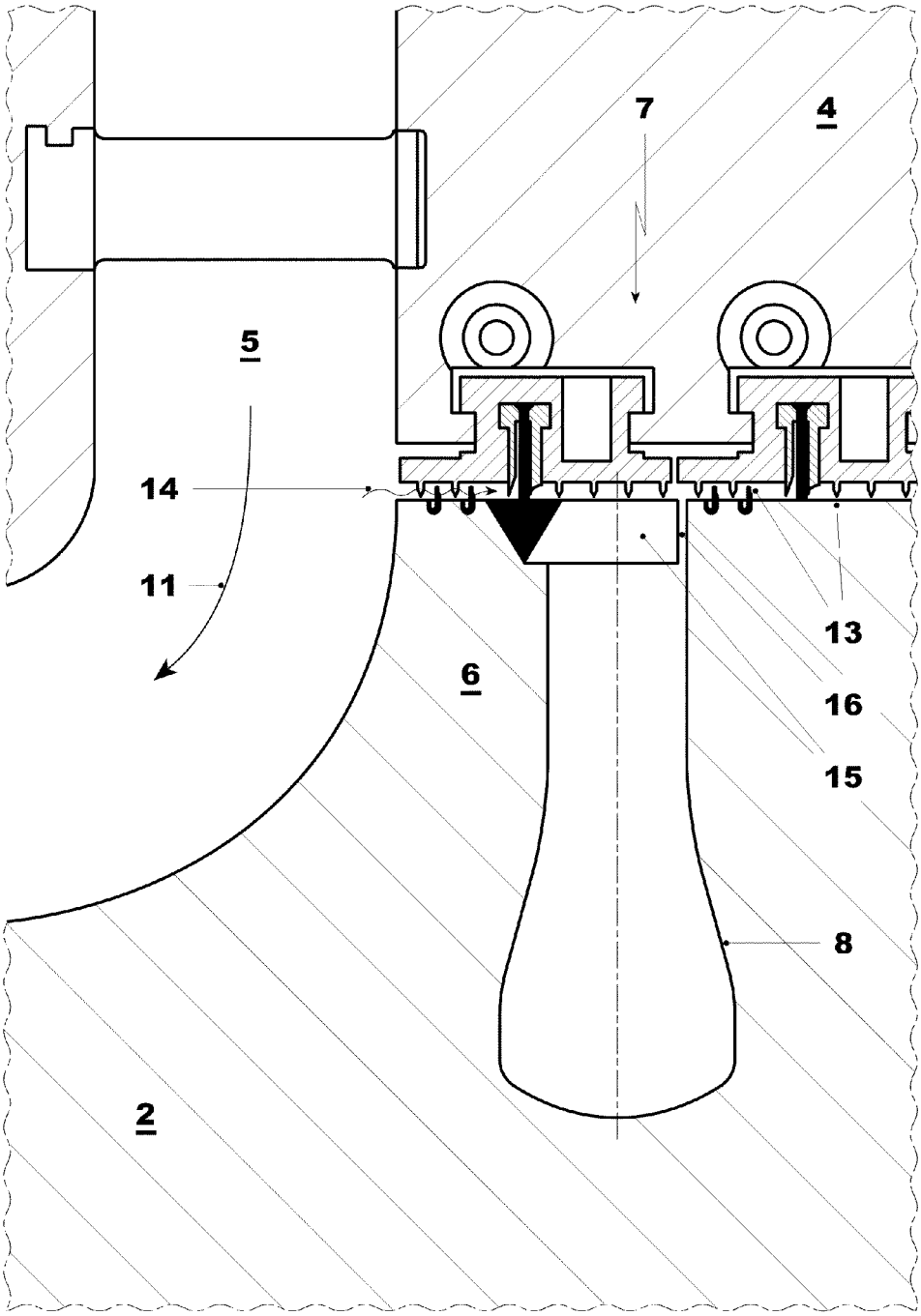
FIG. 2*a* shows a detailed view of the invention with a relief groove with a cover in its arrangement in the piston seal.

FIG. 2*a* shows an embodiment of the relief groove 8 according to the invention, wherein this has a cover 15 on its opening in order to further reduce vortex flows. The cover is connected on one side of the groove 8 to the rotor 2 by means of a welded seam. For example, the groove 8 in the region of its opening has a shoulder 17, on which the cover is arranged. The cover extends over a greater part of the groove opening, wherein an open clearance 16 remains between the cover 15 and the edge of the opening which allows free thermal expansions.

The cover 15, moreover, enables sealing strips 13, which are fastened on the inner casing 4, being able to extend up to the cover 15 in order to thus optimize the sealing effect of the piston seal 7. Moreover, further sealing strips 13 can be fastened on the cover 15 in order to further perfect the sealing effect. The cover, especially with regard to its radial and axial dimensions, is formed so that it can withstand potential vibrations. For example, the cover can have a radial depth which is up to three-quarters of the entire radial depth of the relief groove. In particular, the radial depth of the cover can be between a half and three-quarters of the entire radial depth of the relief groove.

Figure 3:
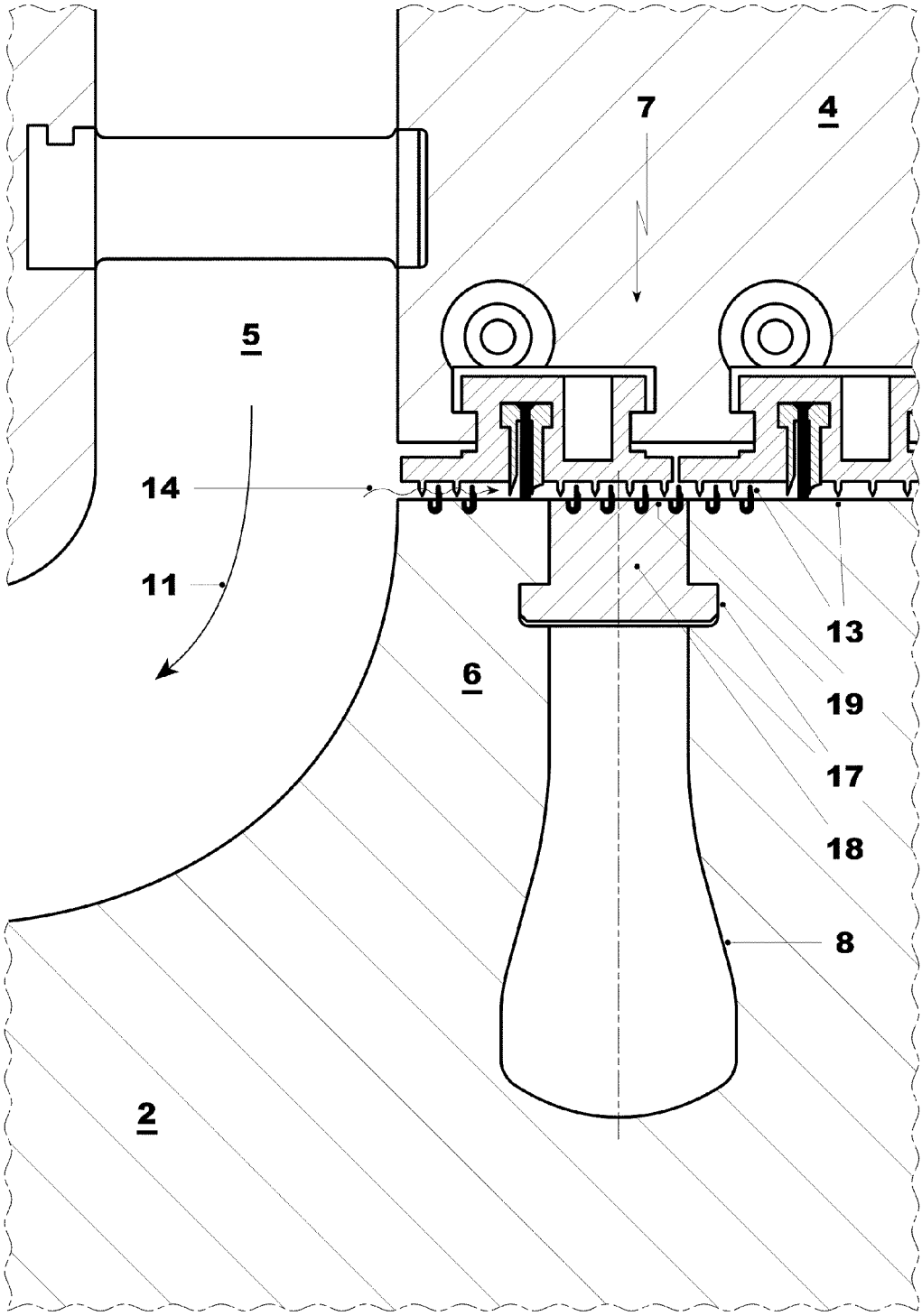
FIG. 3 shows a further embodiment of the invention with a relief groove with a cover in the design of a blade root.

In a further embodiment of the invention according to FIG. 3, the relief groove 8, at least in the region of the rotor surface, is realized in the form of a blade groove 17 with a radially inwards widened region. In addition, an associated cover 18 of the relief groove 8 is realized in the form of a blade root which fits into the groove. In this case, the cover 18 is designed slightly smaller than the groove, so that movements which are induced by thermal expansions are freely permitted.

The blade root-form cover 18, moreover, in this embodiment can have one or more sealing strips 19 which extend towards the inner casing 4.

In an embodiment of the invention according to FIG. 4, the steam turbine again has a relief groove 8 and also a cover of the groove opening level with the rotor surface. The cover in this case is realized by means of a part 20 of the inner casing 4 which extends radially inwards into the groove. Level with the rotor surface, this part 20 has a passage 21 which serves for guiding the leakage flow 14 through the cover and or for preventing the hot flow from finding its way into the groove.

In a particular embodiment, the passage 21 has a first widening 22 at the flow inlet of the bore. As an option, the passage 21 can also have a second widening 23 at the flow outlet in order to further benefit the flow through the passage. The passage 21 can be realized for example by means of a bore with round cross section. Alternatively, the passage can also be realized by milling out, wherein other flow-dynamically more advantageous cross sections can also be realized. Moreover, such passages can also be produced more cost-effectively in this way.

Figure 4:
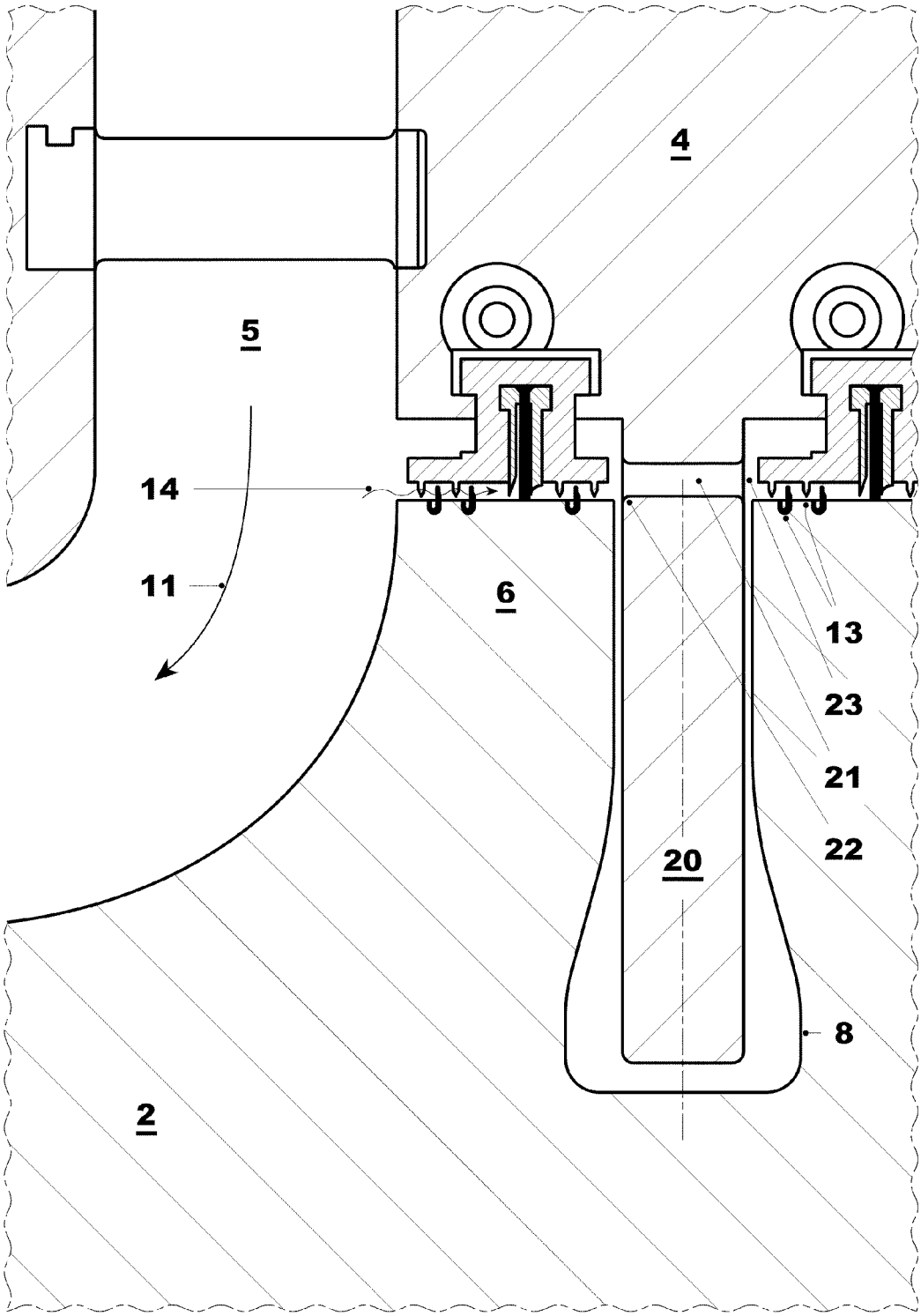
FIG. 4 shows a further embodiment of the invention with a relief groove with a passage for the leakage flow.

In the embodiment according to FIG. 4, the cover is shown as an integral part of the stator. Alternatively to this realization, the cover as a separately produced part is also conceivable, which can be fastened in a groove on the stator by means of hooks or inserting a closed ring, which for production engineering reasons is simpler and more cost-effective.

Figure 5:
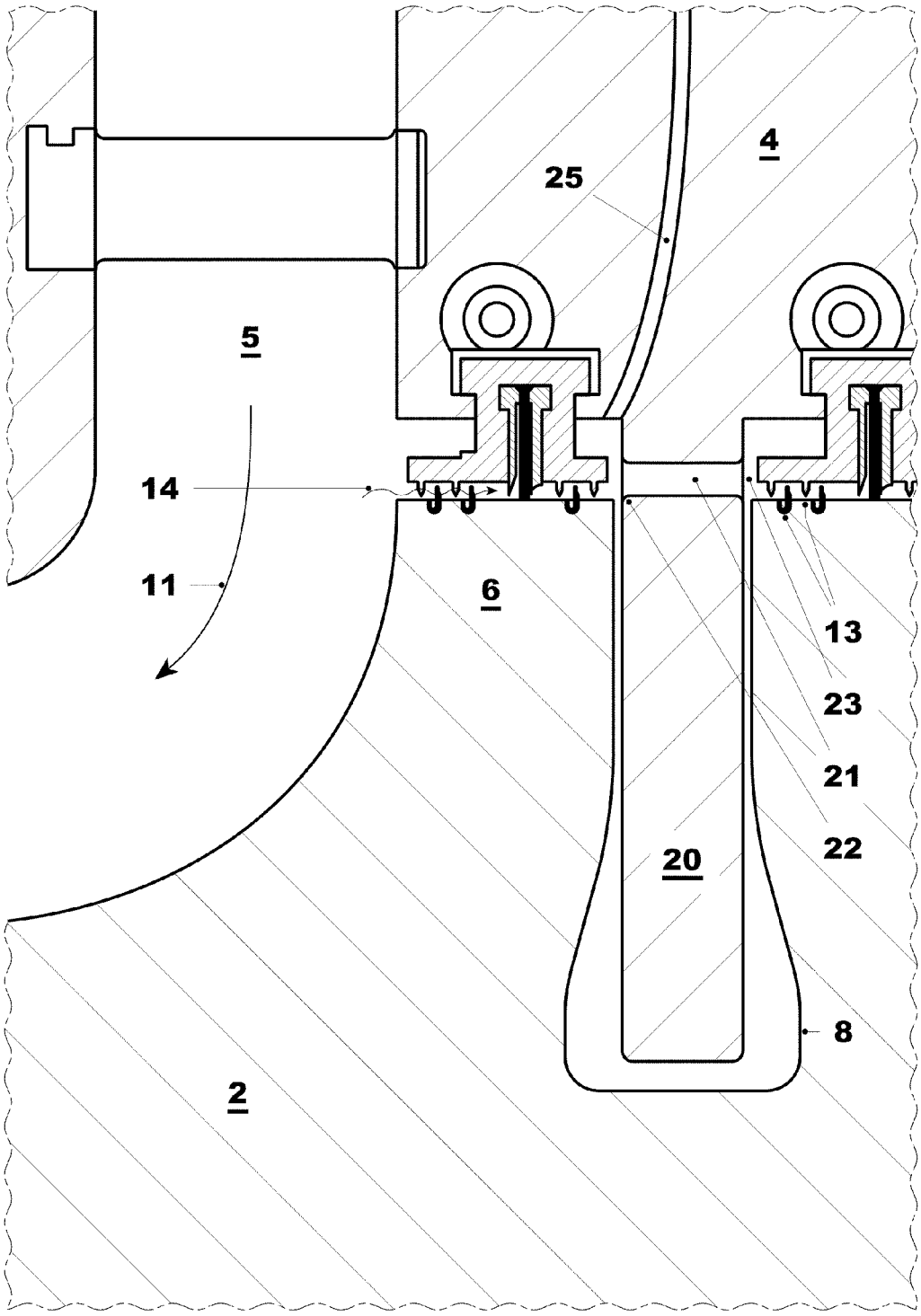
FIG. 5 shows a further embodiment of the invention with a relief groove and an additional cooling device in the stator of the steam turbine.

FIG. 5 shows a steam turbine with a relief groove 8 with a cover 20 of the type as shown in FIG. 4. In addition, the steam turbine has a cooling flow passage 25 which, for example, leads from a superheater, which is not shown, through the inner casing 4 into a chamber in the region of the piston seal and upstream of the cover 20. A leakage flow 14 flows through the piston seal and through the passage 21 of the cover 20. A cooling flow from the passage 25 can find its way into the relief groove and flow around the cover, as a result of which it is cooled.

Figure 6:
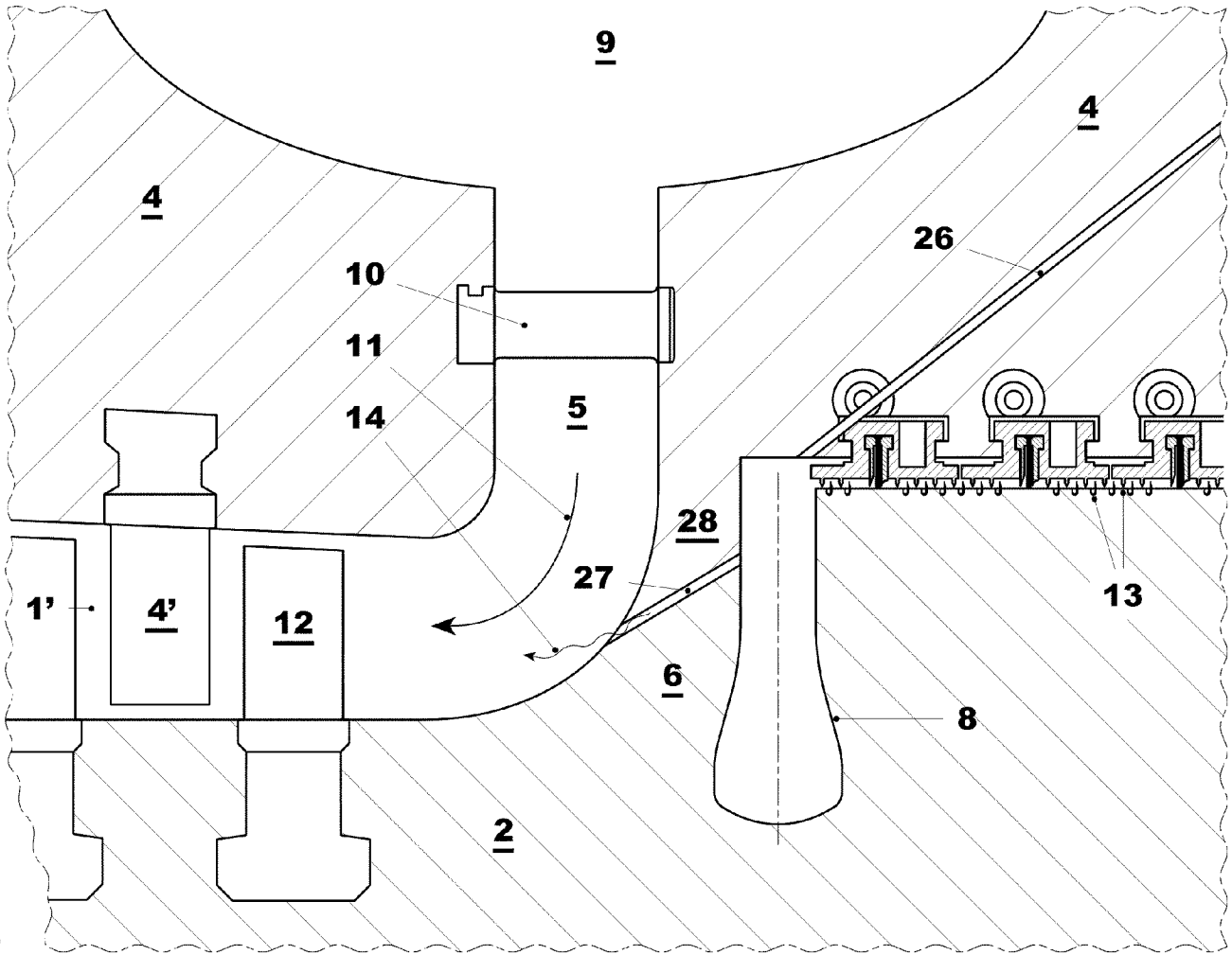
FIG. 6 shows a further embodiment of the invention with cooling of the relief groove from an additional cooling passage.

FIG. 6 shows a further embodiment of a steam turbine with a relief groove 8 and a device for active cooling of the groove. The relief groove 8, however, is of the type as shown in FIG. 1, wherein the groove has no cover. In particular, the steam turbine has a piston seal 13 which extends only after the relief groove 8 and in the axial direction opposite to the direction of the steam flow through the bladed flow path 1' of the turbine. There is no piston seal between the live steam inflow passage and the relief groove 8. Instead, the stator extends in an extension 28 radially inwards up to the region of the bend of the inlet passage 5. A cooling flow passage 26 extends from a suitable cooling steam source through the inner casing 4 to the opening of the relief groove on the rotor surface. The cooling flow finds its way from the relief groove into the live steam inlet passage 5, wherein it flows through a gap 27 between the equalizing piston 6 and the part 28 of the stator into the inlet passage 5. The cooling steam flow expediently has a steam pressure which is higher than that of the steam flow 11 in the inlet passage.

Figure 7:
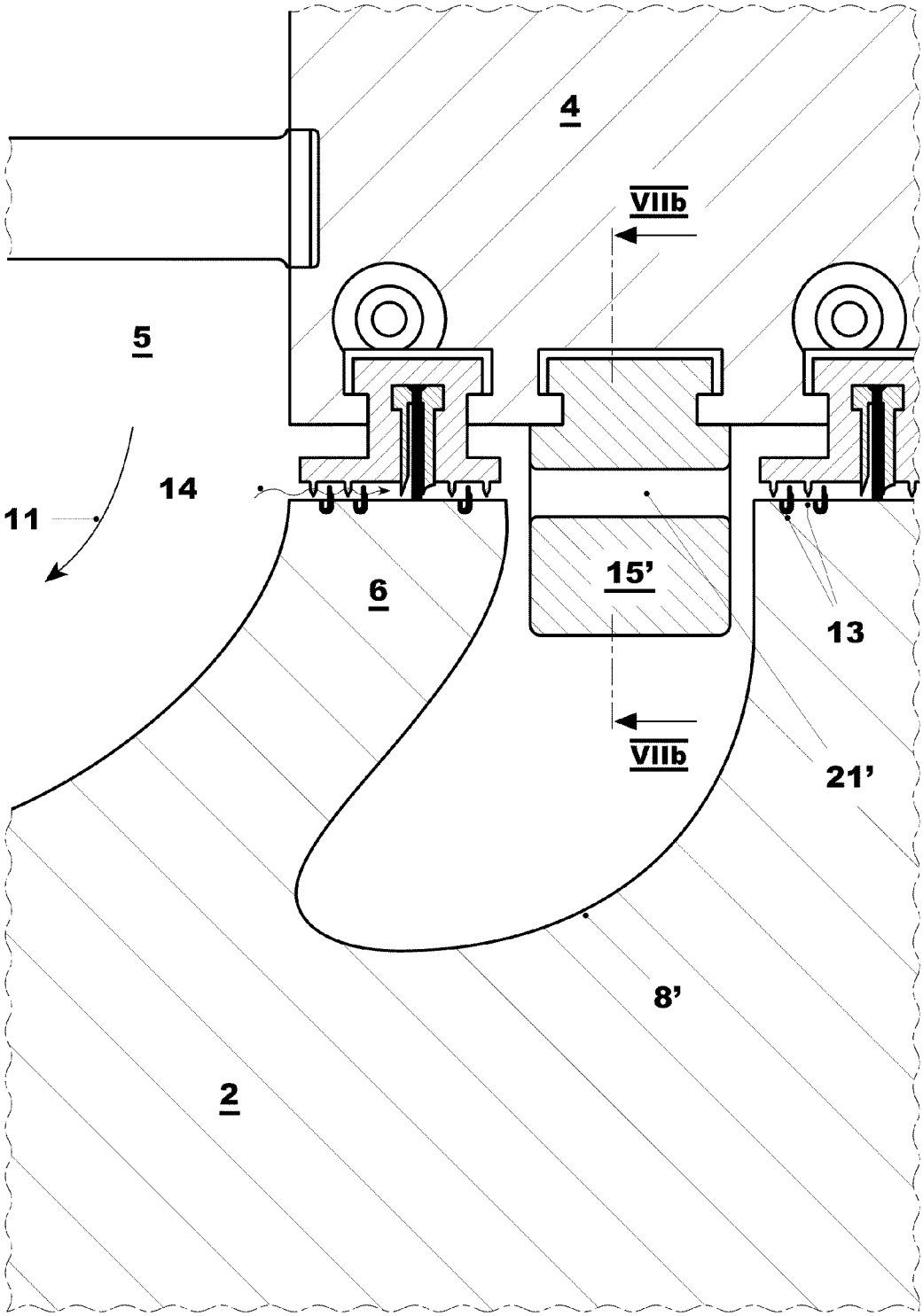
FIG. 7 shows a further embodiment of a relief groove with asymmetrical cross-sectional shape and a radially delimited cover.

FIG. 7 shows an example of a relief groove 8' which is formed asymmetrically in its cross-sectional contour. In particular, the relief groove extends with increasing depth in the direction towards the rotor axis also towards the inlet passage 5. This contour is advantageous by it having curvature radii on one side, which result in lower stresses. In addition, as a result of this shape of the relief groove the distance between relief groove and the first rotor blade row is smaller, which additionally improves the relief. The relief groove 8' can be designed with or without a cover. A cover 15' extends for example radially only over a part of the radial depth of the relief groove.

Figure 7A:
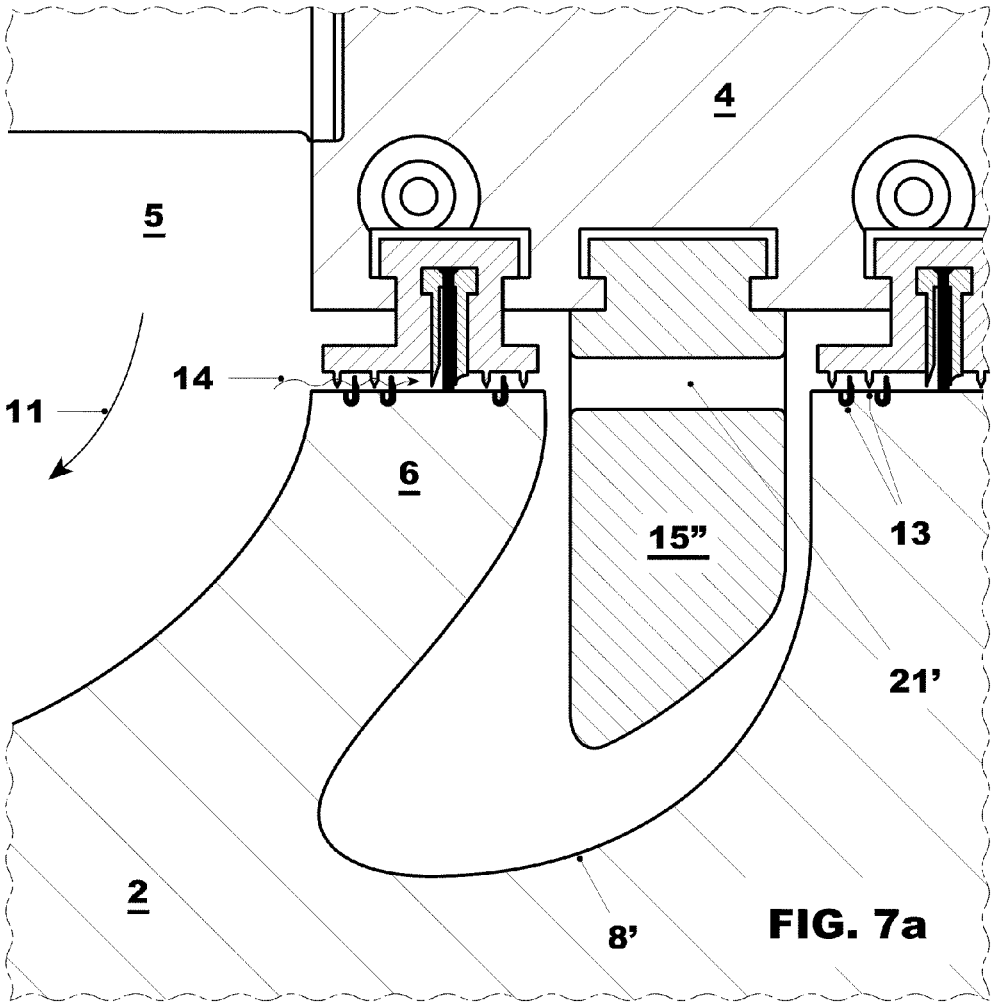
FIG. 7*a* shows a further embodiment of an asymmetrical relief groove with a radially extended cover.

FIG. 7*a* shows a variant of this asymmetrical relief groove with a cover 15" which extends over a greater part of the groove. The radial and axial dimension of the cover influences the heat transfer and also the mass flow resistance in the relief groove in each case.

Figure 7B:
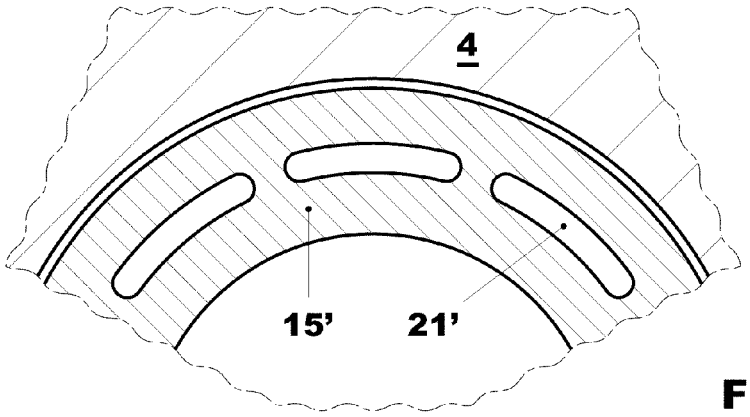
FIG. 7*b* shows a view of a cross section along the rotor axis of the relief groove with a cover according to FIGS. 7 and 7*a* along the line VIIb-VIIb, particularly of the cross-sectional shape of the inner region of the passage for the leakage flow through the cover.

Moreover, the cover 15' or 15" from FIGS. 7 and 7*a* has a passage 21' with a cross-sectional shape according to FIG. 7*b*. The convex contours of the inner walls of the passage 21' on the one hand can be produced cost-effectively by milling out and, moreover, have the effect of the rotor dynamics and the heat transfer in the relief groove being advantageously influenced.

LIST OF DESIGNATIONS

1 Steam turbine
1' Bladed flow path
1" Outer casing
2 Rotor
2' Rotor blades
3 Rotor axis
4 Stator, inner casing
4' Stator blades
5 Inlet passage
6 Equalizing piston
7 Piston seal
8 Relief groove, symmetrical
8' Relief groove, asymmetrical
9 Inlet scroll
10 Guide vane row
11 Steam flow in the inlet passage
12 First rotor blade
13 Sealing strips
14 Leakage flow
15 Cover
15' "Short" cover
15" "Long" cover
16 Clearance
17 Groove in the form of a blade groove
18 Blade root-form cover
19 Sealing strips
20 Part of the inner casing
21 Milled out leakage flow passage
21' Milled out leakage flow passage
22 First widening
23 Second widening
24 Sealing strip
25 Cooling flow passage
26 Cooling flow passage
27 Gap between rotor and stator
28 Stator part, extending radially inwards

What is claimed is:

1. A steam turbine comprising:

a rotor;

a stator;

an inlet passage for a live steam flow, which flows, downstream of the inlet passage, through a bladed flow path of the steam turbine;

a piston seal between the rotor and the stator;

an equalizing piston; and a relief groove on the rotor, wherein the relief groove is arranged in a region of the equalizing piston and extends in a circumferential direction of the rotor, and wherein the relief groove has a cover at an opening thereof.

2. The steam turbine as claimed in claim 1, wherein the relief groove, with regard to a first blade row in the bladed flow path, is arranged, in a region in which the largest thermal stresses can arise in the rotor, on the rotor outside a region in which the steam flow enters the bladed flow path via the inlet passage.

3. The steam turbine as claimed in claim 1, wherein the relief groove is arranged in the region of the piston seal.

4. The steam turbine as claimed in claim 1, wherein the relief groove has a symmetrical shape in a cross section through a rotor axis of the steam turbine.

5. The steam turbine as claimed in claim 1, wherein the relief groove has an asymmetrical shape in a cross section through a rotor axis of the steam turbine, the relief groove extending with increasing radial depth in a direction towards the live steam inlet passage.

6. The steam turbine as claimed in claim 1, wherein the relief groove has a form of a blade groove, and the cover has a form of a blade root.

7. The steam turbine as claimed in claim 1, further comprising sealing strips arranged on the cover.

8. The steam turbine as claimed in claim 1, wherein the cover is formed by a part of the stator.

9. The steam turbine as claimed in claim 1, wherein the cover is formed by a separate part which is fastened on the stator.

10. The steam turbine as claimed in claim 1, wherein the cover has a passage level with a surface of the rotor.

11. The steam turbine as claimed in claim 10, wherein the passage has a first widening at a flow inlet thereof.

12. The steam turbine as claimed in claim 11, wherein the passage has a second widening at a flow outlet thereof.

13. The steam turbine as claimed in claim 1, wherein the steam turbine has a device for cooling the relief groove.

14. The steam turbine as claimed in claim 13, wherein the steam turbine has a cooling passage which leads from a cooling steam source through the stator to the relief groove.

15. The steam turbine as claimed in claim 13, wherein the stator extends radially inwards up to a bend of the live steam inlet passage, and a gap between the stator and the rotor extends from the live steam inlet passage partially axially in a direction opposite to the direction of the operating steam flow in the bladed flow path and partially radially outwards into the relief groove.

16. The steam turbine as claimed in claim 1, wherein the cover has a radial depth which can be up to three-quarters of the entire radial depth of the relief groove.

17. The steam turbine as claimed in claim 1, wherein the rotor is a welded rotor.

* * * * *

UNITED STATES PATENT AND TRADEMARK OFFICE

CERTIFICATE OF CORRECTION

PATENT NO. : 8,684,663 B2
APPLICATION NO. : 12/893761
DATED : April 1, 2014
INVENTOR(S) : Rabiye Bekyigit et al.

It is certified that error appears in the above-identified patent and that said Letters Patent is hereby corrected as shown below:

Title Page, item (75) Inventors: change "Jozo Drmic, Nussabaumen (CH)" to --Jozo Drmic, Nussbaumen (CH)--.

Signed and Sealed this
Sixteenth Day of September, 2014

Michelle K. Lee

Michelle K. Lee
*Deputy Director of the United States Patent and Trademark Office*